US006503670B1

(12) United States Patent
Kuran

(10) Patent No.: US 6,503,670 B1
(45) Date of Patent: Jan. 7, 2003

(54) COLOR FILM RESTORATION PROCESS

(75) Inventor: Peter Kuran, Sylmar, CA (US)

(73) Assignee: VCE.com, Inc, Sylmar, CA (US)

( * ) Notice: Subject to any disclaimer, the term of this patent is extended or adjusted under 35 U.S.C. 154(b) by 0 days.

(21) Appl. No.: 09/893,072

(22) Filed: Jun. 27, 2001

(51) Int. Cl.[7] ..... G03C 7/18; G03C 7/20; G03C 7/22

(52) U.S. Cl. ..... 430/22; 430/356; 430/357; 430/359; 430/367; 430/373; 355/32

(58) Field of Search ..... 430/356, 357, 430/359, 367, 22, 373; 355/32

(56) References Cited

U.S. PATENT DOCUMENTS

| | | | | | |
|---|---|---|---|---|---|
| 3,329,501 | A | * | 7/1967 | Peaty | 430/359 |
| 3,337,343 | A | * | 8/1967 | Hove | 430/359 |
| 4,717,646 | A | * | 1/1988 | Giorgi | 430/359 |
| 4,810,602 | A | * | 3/1989 | Wittcox et al. | 430/367 |
| 4,968,587 | A | * | 11/1990 | Sekine | 430/367 |

FOREIGN PATENT DOCUMENTS

WO WO 96/33443 * 10/1996

OTHER PUBLICATIONS

Desowitz, Bill, "Film Restoration More Than 'Rear Window'—dressing," http://www.cnn.com/SHOWBIZ/9712/11/rearwindow.restoration.lat (Dec. 1997).
Fielding, Raymond, "The Technique of Special Effects Cinematogaphy," Focal Press, pp. 197–198, Chapter 8 (Traveling Mattes), 1985.
Kuran, Peter, "Optical Restoration of Faded 35mm Color Negative," SMPTE Journal, pp. 281–284 (May 1997).
"May the Force be with you."http:\\movieweb.com/movie/starwars/swprod.txt, (retrieved Aug. 2001).
"Eastman Direct MP Film 5360™/7360™", Eastman Kodak Company, pp. 1–3, Publication No. H–1–5360 (Mar. 1999).
"Kodak Panchromatic Separation Film 2238," Eastman Kodak Company, Kodak Publication No. H–1–328, Rochester, New York (1999).
Eastman Professional Motion Picture Films, Eastman Kodak Company, Third Edition, First Printing, Rochester, pp. 1–120, Kodak Publication No. H–1, New York (1982).
Hunt, C. Bradley, "Corrective Reproduction of Faded Color Motion Picture Prints," Society of Motion Picture and Television Engineers Journal, Jul. 1981, pp. 591–596, New York.

* cited by examiner

*Primary Examiner*—Richard L. Schilling
(74) *Attorney, Agent, or Firm*—Christie, Parker & Hale, LLP

(57) ABSTRACT

A process for restoring the color of faded color negative film, particular for faded color motion pictures. The original faded negative film is used to produce a green enhancement mask and a blue enhancement mask (or a combination green/blue enhancement mask). Standard red, green, and blue separations are also made from the original faded negative. By combining the green and blue enhancement masks with the standard green and blue separations, respectively, (or the combination green/blue enhancement mask with the green separations and blue separations), enhanced green and blue separations are created. The enhanced green separation, the enhanced blue separation, and the red separation are recombined to form the restored color negative or interpositive. Alternately, from the original negative, an enhanced blue mask can be created, and intermediate film stock printed with yellow light passed through the original negative to produce unprocessed intermediate stock can be created. The blue mask, and optionally the original negative, and the unprocessed intermediate stock can be packed and exposed with blue light to create improved intermediate stock, which can then be developed. The intermediate film stock can be negative film or interpositive film.

19 Claims, 6 Drawing Sheets

COLOR FILM RESTORATION PROCESS

FIELD OF THE INVENTION

This invention relates generally to processes and apparatuses for restoring color film, and, in particular embodiments, to a process for restoring color of motion picture color negative film.

BACKGROUND OF THE INVENTION

Color negative film has been a popular recording medium for decades. However, color films, especially those produced in the early stages of color film technology, tend to fade over time. For color image restoration processes, this is especially problematic with motion picture color negative film, wherein thousands of images may be found on a single reel of film. Significant fading of motion picture color negative film has been known to occur in as little as ten years. Fading tends to occur primarily in the blue layer and somewhat in the green layer. The unstable blue layer often fades such that the highlights and shadow areas (D-Max and D-Min) are close to each other in density and present a false color of the original image. So, for example, a color negative from the 1950's may now provide a somewhat soupy green appearance, when printed using, for example, Laboratory Aim Densities, which were established by Eastman Kodak. Laboratory Aim Density is a control for standardizing color reproduction.

Another example of color deterioration that tends to occur in color negative films is a fading in which the highlights or white areas appear yellow, while the shadow or dark areas of the image appear blue. This fading characteristic, known as crossover, can prevent an image produced from an original negative from being true to the correct color.

One process for restoring color of faded or discolored color photographs (not of negatives) is by chemically treating the photographs (see U.S. Pat. No. 4,717,646). In that process, faded or discolored color photographs are cleaned with a water-free application of anhydrous acetone-free diacetone and coated with a color corrective restoration solution. Exposing certain old photographs or other film media to chemical treatments, however, may not be favored because of the risk of damaging or destroying the media.

Today, typically color negatives are protected by striking an interpositive from the original negative. A duplicate negative can be created from the interpositive. New projection prints created from the duplicate negative can be equal in quality to those generated from the original negative. However, negatives that, for example, are over 30 years old may no longer be capable of being restored to their original colors. Even basic enhancement through the interpositive to duplicate negative process typically is substantially ineffective in restoring the original colors. While it may be possible to correct the light areas with the interpositive to duplicate negative process, the process tends to cause the dark areas to become discolored into the blue range.

Another way to preserve color film negatives is to create three black and white negatives bearing a red, blue and green image of the color film negative, respectively. Since black and white film tend to last longer, this method can be effectively used to recreate new color negatives. This method, however, is not useful where the original film was not preserved in this manner.

The inventor herein had a prior method of restoring faded color negatives outlined in the *SMPTE Journal*, May 1997, pp. 281–284. This method proved to be too awkward and costly since it requires significant changes to normal laboratory procedures.

Computerized scanning systems permit film to be scanned, and then digitally altered and enhanced. However, digital enhancement continues to remain expensive, and results in a digital output, rather than a film output.

Therefore, there exists a need for a cost-effective method and system for restoring color negative film which has faded over time, without the need to expose the original negatives to chemicals or expensive mechanical or digital processing.

SUMMARY OF THE INVENTION

In accordance with the present invention, a process for restoring color of a color negative (e.g., a copy of an original negative), motion picture color negative film (for example, 16 mm, 35 mm, 70 mm and other motion picture color negative film produced by the Eastman Kodak Co., Fuji, Agfa, and others), and other types of film.

In one aspect of the invention, the process comprises the steps of making red, green and blue separations and then recombining them to form a color enhanced internegative or interpositive.

In another aspect, the invention comprises the following steps:

Step 1: From the original faded color negative, print onto orthochromatic film stock that is sensitive only to blue and A green light, such as Eastman Direct MP Film Type 5360, using green light. This will create a black and white enhancement mask record of green information with a negative image ("green 5360".) From the original faded color negative, additionally print onto orthochromatic film stock using blue light. This will create a black and white enhancement mask record of blue information with a negative image ("blue 5360").

Step 2: From the original color negative, make a standard red separation on standard separation stock. From the original color negative, print a pass of green light onto separation stock (to create a standard green separation), then a second pass using the green 5360 enhancement mask onto the same piece of separation stock in sync. The exposure from the green 5360 enhancement mask helps in improving the density of the final improved green separation. From the original color negative, print a pass of blue light onto separation stock (to create a standard blue separation), then a second pass using the blue 5360 enhancement mask onto the same piece of separation stock in sync. The exposure from the blue 5360 enhancement mask helps in improving the density of the final blue separation. It is on the improved green and blue separations that the improvement of color has taken place.

Step 3: Finally, take the resulting red, and improved green and blue (RGB) separations and recombine them on to color internegative film to create a final internegative from which color prints can be struck.

The inventor has found that in many cases, the green record fades less than the blue record, so it may not always be necessary to create a separate enhanced green separation.

In another embodiment of the process, the original faded negative is first used to make a single black and white record of the faded green and blue record of the original negative. This can be done by using an orthochromatic film that is only sensitive to blue and green light, such as Eastman Direct MP Film Type 5630 ("5360"). The 5360 separates the green and blue records (the records which fade) and provides a way of increasing density without increasing grain by way of a second pass from the 5360 element on the separations, thereby rebalancing the color information.

Next, the separations are made. Once the 5360 element has been made form the original negative, it is then run as a separate pass while making the separations of the original faded negative on a contact printer for the single green and blue separations (e.g., using a pass with green light to create a green separation, and a pass with blue light to create a blue separation.) This will give increased density to the green and blue separations. The red separation is made from the original faded negative using standard black and white separation film stock (since fading does not occur in the red record). Once the red separation and enhanced blue and green separations are made, they can be recombined at any later time to make a renewed internegative with enhanced color.

In a further embodiment of the invention, color prints and interpositives can be made on a registration contact printer or other types of printers. In this embodiment, the original faded color negative is taken, and is overlaid onto orthochromatic film stock that is sensitive only to blue and green light, such as Eastman Direct MP Film Type 5360. Using blue light, a blue 5360 autopositive mask is made. Next, from the original negative, one pass of the original negative is printed onto intermediate stock, which can be color print stock or interpositive stock using a strong yellow light so that the resulting image appears very blue in the mid-tones and shadow areas and the highlights appear neutral in color. Next, a second pass is printed in tri-pack (the tri-pack being the intermediate stock printed in the first pass, the original negative and the blue 5360 autopositive mask) by combining the three films in a contact printer using a strong blue light. The result is that the intermediate stock will have an additional exposure with the blue 5360 autopositive mask and the original negative. This creates yellow light in the shadows and mid-tones, thus neutralizing the blue cast and making the final image appear normal. Thus, a color enhanced color print or interpositive will be created.

In yet a further embodiment of the invention, color prints and interpositives can be made on a registration contact printer or other types of printers using a bi-pack process. In this embodiment, the original faded color negative is taken, and is overlaid onto orthochromatic film stock that is sensitive only to blue and green light, such as Eastman Direct MP Film Type 5360. Using blue light, a blue 5360 autopositive mask is made. Next, the original negative is bi-packed with intermediate stock (either color print film or interpositive film) and is exposed with yellow biased light, and preferably strong yellow light. In a second pass, the 5360 autopositive film is overlaid on the intermediate stock previously exposed in the first pass, and is exposed with blue light to create a color enhanced print (when print film is used) and a color enhanced interpositive (when intermediate film is used).

The above discussed and many other features and attendant advantages of the present invention will become better understood by reference to the following detailed description, when considered in conjunction with the accompanying drawings.

DETAILED DESCRIPTION OF THE INVENTION

Figure 1:
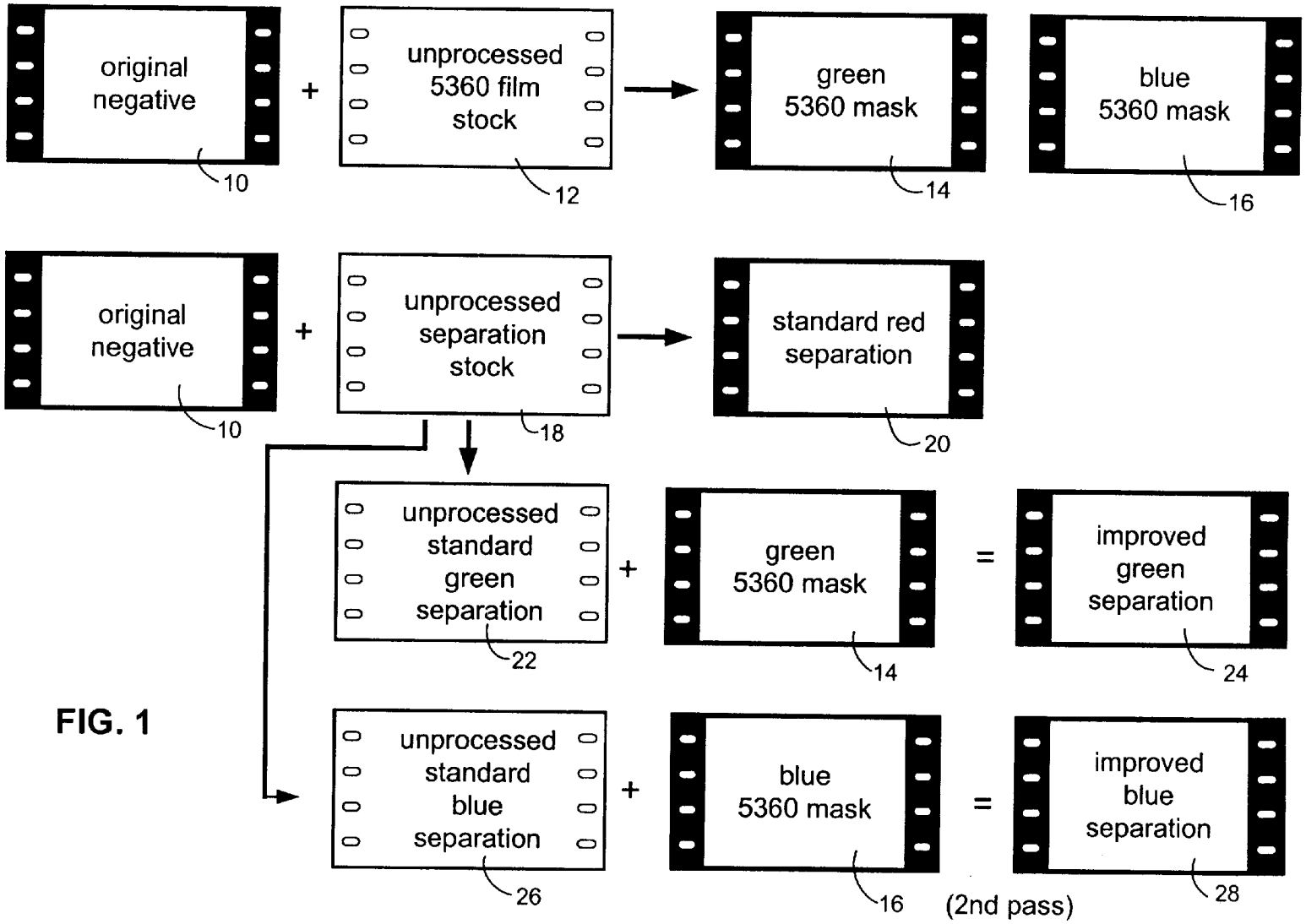
FIG. 1 is a block diagram illustrating the steps of the invention of generating standard red, green and blue separations, preparing green and blue enhancement masks and combining the enhancement masks with the separations to form improved green and improved blue separation, which when recombined with the red separation can be used to recreate improved color negatives.

FIG. 1 is a block diagram illustrating the steps of the invention of generating standard red, green, and blue separations from a faded negative, preparing green and blue enhancement masks, and combining the green and blue enhancement masks with the standard green and blue separations to form improved green and blue separations, which when combined the standard red separations can be used to recreate improved color in internegatives or duplicate negatives. From the original faded color negative 10, which has faded blue and green records, an orthochromatic film 12 that is sensitive only to blue and green light, such as Eastman Kodak Direct MP film type 5360 is taken. Using green light, a green 5360 enhancement mask 14 of the original faded negative is created. This green 5360 mask 14 is a black and white record of the green information with the negative image. From the original faded color negative, another roll of 5360 orthochromatic film 12 is taken, and by using blue light, a blue 5360 mask 16 is created. This can be done in a contact printing procedure, by optical printing, or other known processes. In a second step, the original negative 10 is taken, and using standard separation stock 18 such as Eastman, Panchromatic Separation Type 2238 (or 5235), a standard red separation 20 is printed using red light. No further processing is required of the standard red separation 20, and it can be developed after this point. Next, from the original faded color negative 10, a pass of green light is passed through the original negative onto another strip of separation stock 18 to create an unprocessed standard green separation 22. Then, in a second pass using the green 5360 mask 14, the unprocessed standard green separation 22 is exposed in sync. The exposure from the double pass creates an improved green separation 24, which can then be processed. Next, from the original faded color negative 10, a pass of blue light is passed through the original negative onto another strip of separation stock 18 to create an unprocessed standard blue separation 26. Then, in a second pass using the blue 5360 mask 16, the unprocessed standard blue separation 26 is exposed in sync. The exposure from the double pass creates an improved green separation 28. It is on the improved green separation 24 and improved blue separation 28 that the improvement in color has taken place. As noted above, since the red record does not tend to fade, no enhancement of the red separation is required. As noted above, the green record fades less than the blue records. In these cases, the step of forming the improved green separation 24 can be skipped, and standard green separations can be generated and used in lieu of improved green separations.

Figure 1A:
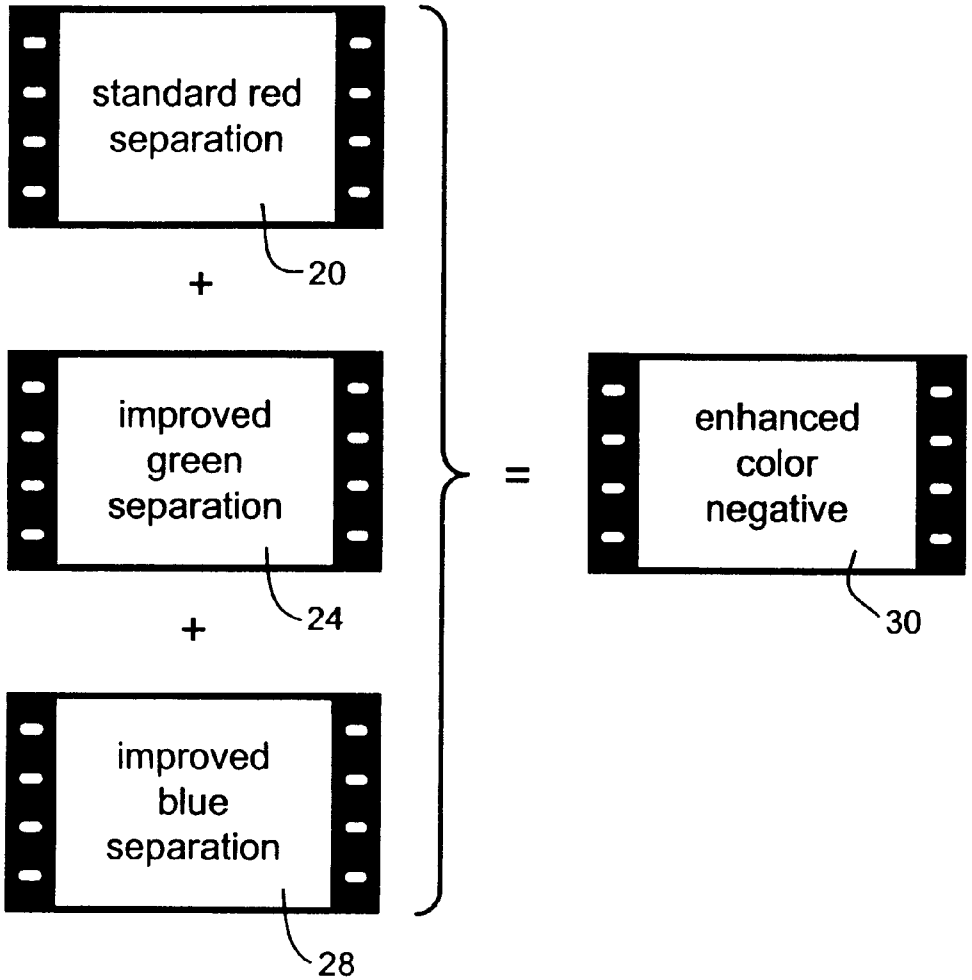
FIG. 1A is a block diagram illustrating the steps to combine the red separation, the enhanced green separation, and the enhanced blue separation to form the enhanced color negative.

Turning to FIG. 1A, the standard red separation 20, the improved green separation 24, and the improved blue separation 28 can be recombined immediately to form an enhanced color negative 30 or, can be stored by separate black and white records of the red, green and blue records of the restored color film for long-term storage and combined at any later time to create a renewed and enhanced color negative 30. If a standard green separation is utilized instead of an improved green separation, then the standard red separation, the standard green separation, and improved blue separation can be stored and recombined to form the enhanced color negative.

Figure 2:
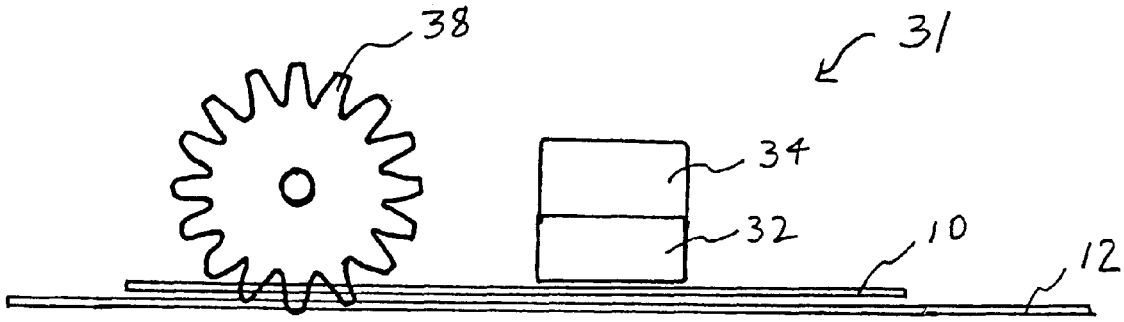
FIG. 2 is a side view showing how the generation of the green 5360 and blue 5360 masks of FIG. 1 are achieved by contact printing.

Turning to FIG. 2, the green 5360 mask and the blue 5360 mask can be created in a contact printing process 31 wherein the original negative 10 is fed through a contact printer having an aperature 32 and a light 34 which projects through the frames of the original faded negative 10 and onto aligned and registered orthochromatic film stock 12, such as the above-identified Eastman 5360 Type. By using a green light (e.g. placing a green filter in front of a white light), the green 5360 enhancement mask 14 will be formed. Taking the same original negative, and a new roll of orthochromatic stock, blue light (e.g. placing a blue filter in front of a white light) will be passed through the original negative to create a blue 5360 enhancement mask 16. The same process can be used to create standard red separation 20, standard green separation 22, and standard blue separation 28, except that standard separations stock, such as Eastman Panchromatic Separation Type 2238 or 5235 (or any other separation film stock) is utilized. An alignment device 38, such as a gear or rachet that fits in within the registration perforations of the film stock will ensure that the film stock 12/18 and original negative film 10 are accurately aligned during the contact printing process.

Figure 3:
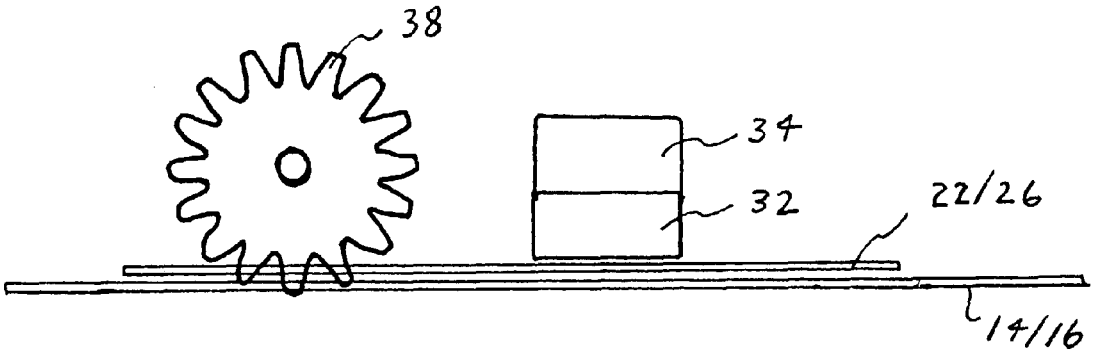
FIG. 3 is a side view showing how improved green and blue separations are made in a contact printing process.

Turning to FIG. 3, there is shown a prospective view of the process of producing the improved green separation 24 and the improved blue separation 28 using a contact printing process 40. In this process, the contact printer having an aperture 32 and a light 34 and a registration device 38 are utilized. The registration device 38 is used to align the standard green separation 22 or standard blue separation 26 with the green 5360 enhancement mask 14 or the blue 5360 enhancement mask 16, respectively, to form an improved green separation 24 and an improved blue separation 28. In the second pass to create the improved green separation 24, either green light or white light is used, and in creating the improved blue separation either blue light or white light is used. Thus, a great advantage of the instant method is that the system can work within the standard operating procedures of our existing film laboratories and requires few steps and fewer pieces of intermediate film stock than other methods. Furthermore, the method will produce a more accurate color than previous chemical methods.

Figure 4:
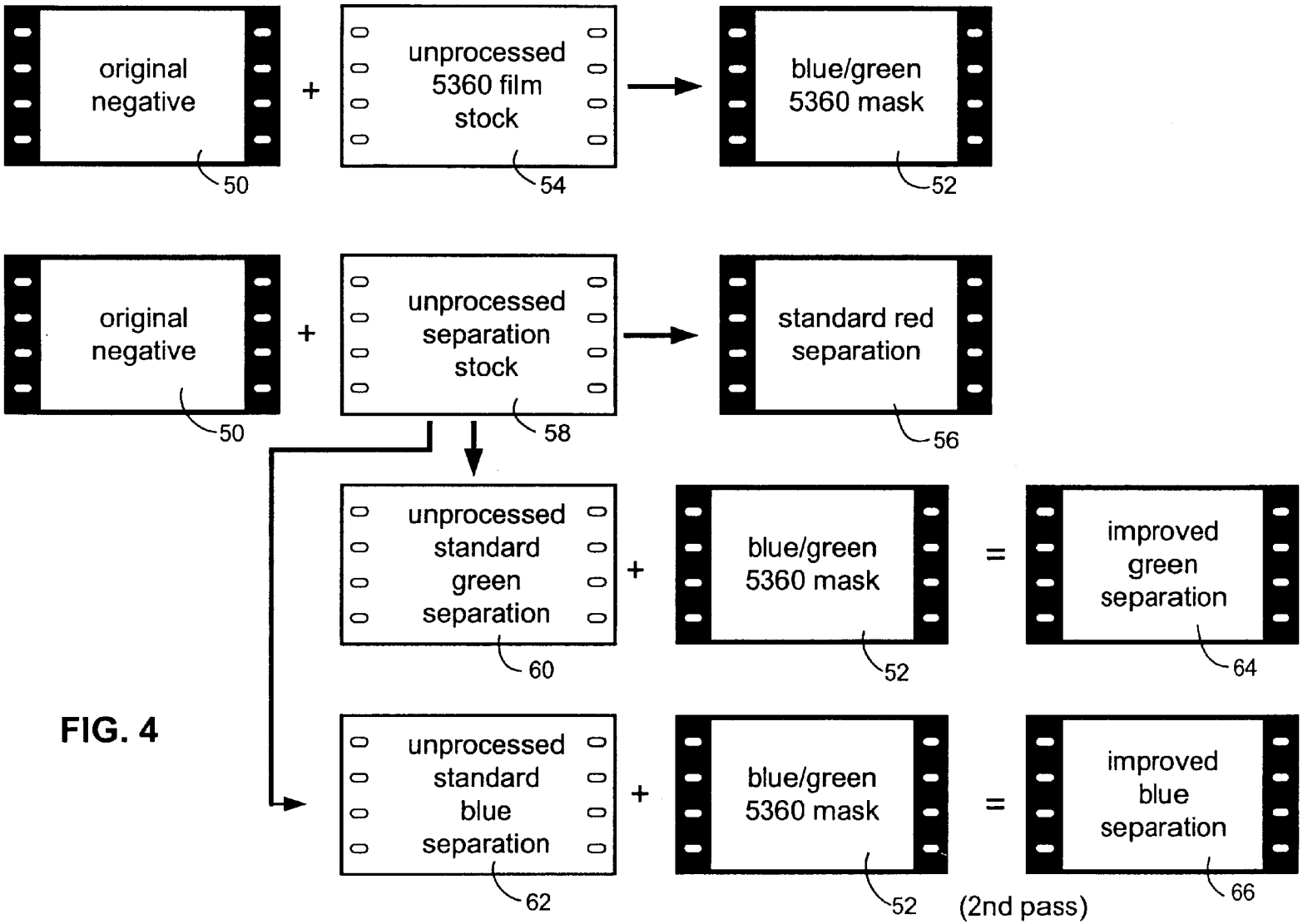
FIG. 4 is a block diagram illustrating the steps of a second embodiment of the invention.

Turning to FIG. 4, there is an alternative embodiment of the invention which is similar to that of the first embodiment. In this second embodiment, an original negative 50 is taken, and a combination blue/green 5360 mask 52 is made. The blue/green 5360 mask 52 is created in the same manner as the green 5360 mask 12 and blue 5360 mask 14 as described with respect to FIG. 1, except that instead of using green and blue lights, respectively, projected through the original faded negative 50 onto 5360 film stock 54, either a white light, or a green and blue light can be used to print one single blue/green 5360 mask 52. Next, the original negative 50 is used to create a standard red separation 56 by passing a red light through the original negative 50 onto a strip of separation stock 58. No further processing is required of the standard red separation 56, and it can be developed after this point. A standard green separation 60 is made by passing green light through the original negative 50 onto another strip of standard separation stock 58, and a standard blue separation 62 is created by passing blue light through the original negative 50 onto yet another strip of standard separation stock 58. At this point, the standard green and blue separation 60 and 62 remain unprocessed. Taking the green/blue 5360 enhancement mask 52, green light is projected through this back onto the standard green separation 60 to create an improved green separation 64. Taking the blue/green 5360 enhancement mask 52, blue light is projected through this back onto the standard blue separation 62 to create an improved blue separation 64.

As with the first embodiment, the standard red separation 54, the improved green separation 60 and the improved blue separation 62 can be recombined to create an enhanced color negative either immediately, or at some time in the future. Since black and white records of the blue, red and green separations are relatively long lasting, the color quality can be preserved for long periods of time. Also, as in the first embodiment, if the green record of the original faded color negative is not degraded much, it is also possible to forego the step of forming the improved green separation, and instead create a standard green separation without enhancement.

Figure 5:
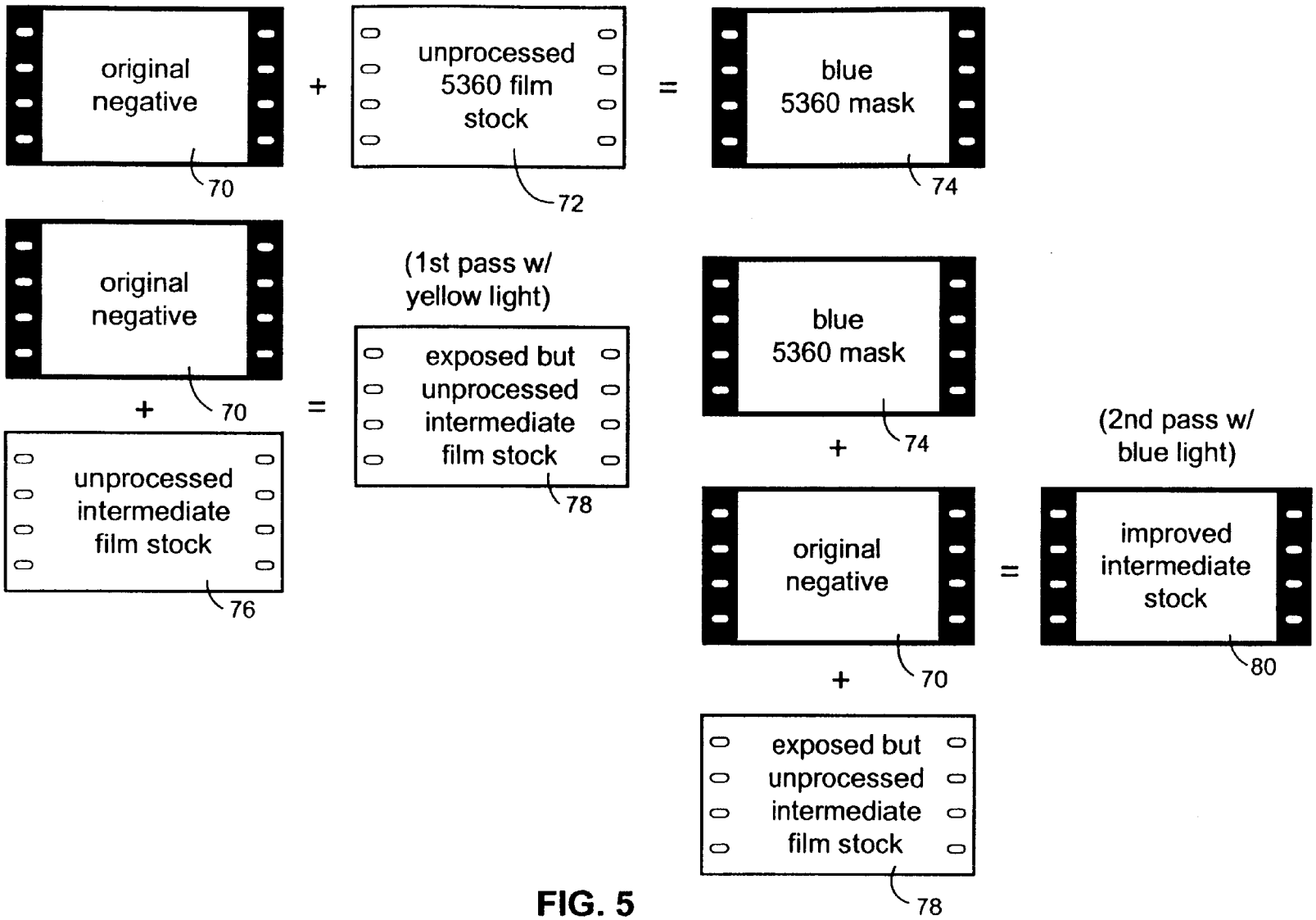
FIG. 5 is a block diagram illustrating the steps of a third embodiment of the invention.

Turning to FIG. 5, a further embodiment of the invention is shown. In this embodiment of the invention, color prints and interpositives can be made on a registration contact printer or other types of printers. The original faded color negative 70 is taken, and is overlaid onto orthochromatic film stock 72 that is sensitive only to blue and green light, such as Eastman Direct MP Film Type 5360. Using blue light, a 5360 autopositive mask 74 is made. Next, from the original negative 70, one pass of the original negative 10 is printed onto color print or interpositive (intermediate) stock 76 using a strong yellow light so that the exposed unprocessed intermediate stock 78 has an image that appears very blue in the mid-tones and shadow areas and has highlights appear neutral in color. Next, a second pass is printed in tri-pack (the tri-pack being the blue 5360 autopositive mask 74, the original negative 70, and the unprocessed intermediate stock 78, ) by combining the three films in a contact printer using a strong blue light. The result is that the improved intermediate stock 80 will have an additional exposure with the blue 5360 mask 74 and the original negative 70. This creates yellow light in the shadows and mid-tones and highlights that are whiter, thus neutralizing the blue cast and making the final color image appear normal. As noted above, the improved intermediate stock can be interpositive film or duplicate negative film.

Figure 6:
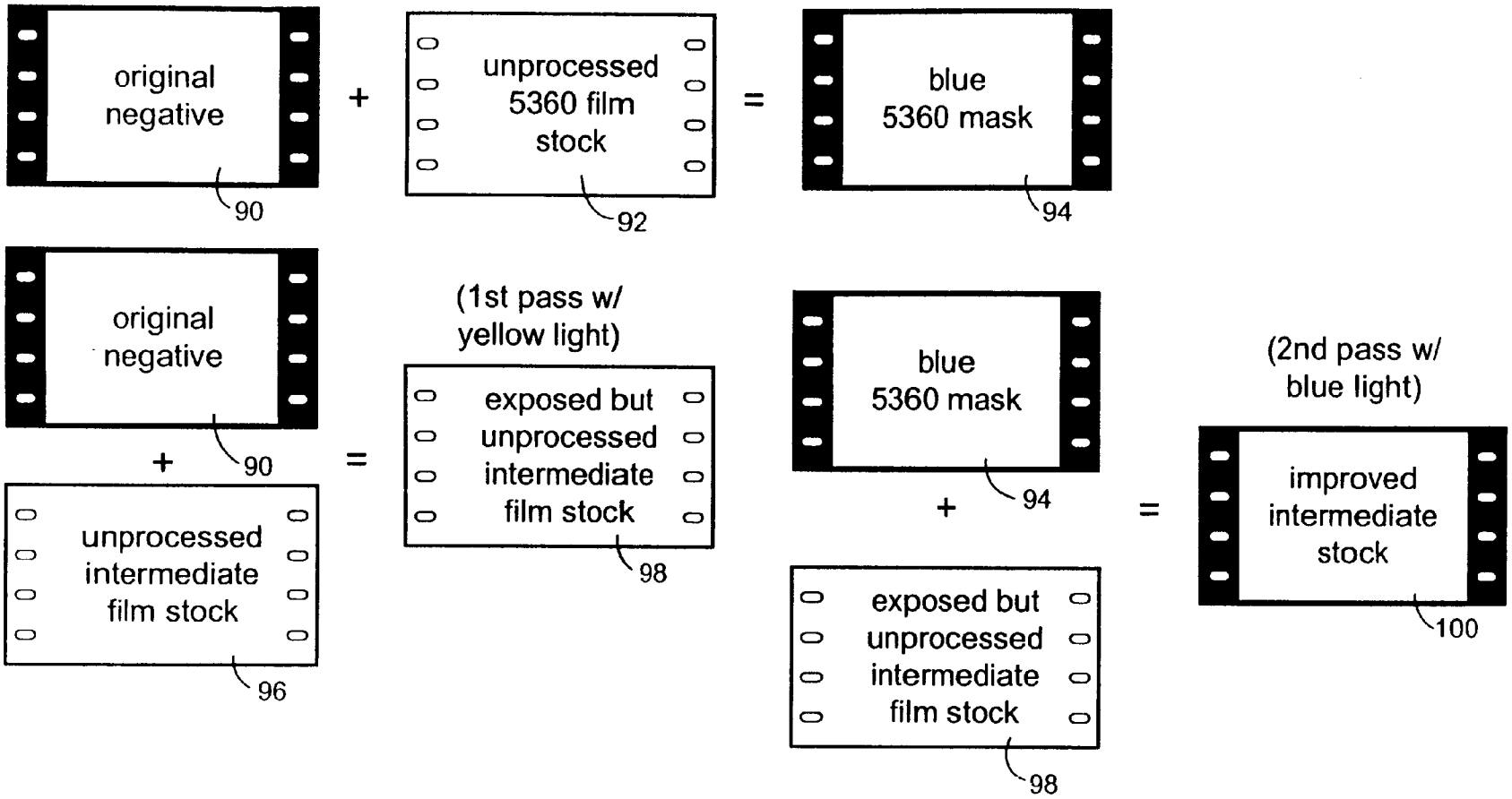
FIG. 6 is a block diagram illustrating the steps of a fourth embodiment of the invention.

FIG. 6 shows a further embodiment of the invention wherein color prints and interpositives can be made on a registration contact printer or other types of printers. In this embodiment, the original faded color negative 90 is taken, and is overlaid onto orthochromatic film stock 92 that is sensitive only to blue and green light, such as Eastman Direct MP Film Type 5360. Using blue light, a blue 5360 mask 94 is made. Next, from the original negative 90, one pass of the original negative is printed onto color print or interpositive (intermediate) stock 96 using a strong yellow light so that the exposed but unprocessed intermediate stock 98 has an image that appears very blue in the mid-tones and shadow areas and has highlights that appear neutral in color. Next, a second pass is printed in bi-pack (the bi-pack being the blue 5360 autopositive mask 94 and the unprocessed intermediate stock 98) by combining the two films in a contact printer using a strong blue light. The result is that the improved intermediate stock 100 will have an additional exposure with the blue 5360 mask. This creates yellow light in the shadows and mid-tones, thus neutralizing the blue cast and making the final image appear normal. As noted above, the improved intermediate stock can be interpositive film or duplicate negative film. While this bi-pack method may produce less improvement in the final improved intermediate stock 100 than the tri-pack method shown in FIG. 5, it may be less costly and usable where tri-pack equipment is not available, or a lower cost solutions is desired.

As noted in a technical data sheet on Eastman Direct MP Film 5360/7360, dated March, 1999, document H-1-5360, the orthochromatic film stock 5360 offered by the Eastman Kodak Company is an autopositive film stock for making black-and-white direct reversal duplicates of black-and-white negative or positive film, or of color print films. Its primary prior application as been in producing workprints and musical scoring prints for editing purposes. The duplicates, however, will not necessarily be of release print quality. This low-speed, orthochromatic reversal film is characterised by ultrahigh resolving power and adjustable contrast. Although it is reversal film, it is processed in a conventional black-and-white process rather than a reversal process. The image produced has the same tonal-scale orientation as the film from which it is printed i.e. a negative from a negative, or a positive from a positive.

While the processes of the invention have been described with respect to contact printing methods, the process can also be carried out using optical printing methods rather than contacting printing methods, with much the same results.

The processes described above may be used on a variety of color negatives, not just motion picture negatives, such as 35 mm motion picture negatives. Indeed the processes could be used on individual copies of original color negatives. However, the synchronized printing/recording steps using the apparatuses shown in FIGS. 2 and 3 are especially efficient with respect to practicing embodiments of the inventive process with motion picture film.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A process for restoring color of a faded color negative, the process comprising the steps of:

taking a faded color negative, and creating a blue enhancement mask of the faded color negative by providing black and white autopositive orthochromatic film stock that is sensitive only to blue and green light, and by passing blue light through the faded color negative onto the autopositive orthochromatic film stock and developing unexposed areas to create the blue enhancement mask;

generating a red separation, a green separation, and a blue separation from the faded color negative by exposing black and white negative film stock and developing the exposed areas of the film negative; and combining the blue separation with the blue enhancement mask to create an improved blue separation.

2. A process of claim 1, further comprising the steps of taking the faded color negative, and creating a green enhancement mask of the faded color negative by providing black and white autopositive orthochromatic film stock that is sensitive only to blue and green light, and by passing green light through the faded color negative onto the autopositive orthochromatic film stock and developing unexposed areas to create the green enhancement mask and combining the green separation and the green enhancement mask to create and improved green separation.

3. A process of claim 1, wherein the red separation, the green separation, and the improved blue separation can be recombined to form an enhanced color negative.

4. A process of claim 2, wherein the red separation, the improved green separation, and the improved blue separation can be recombined to form an enhanced color negative.

5. The process of claim 2, wherein the steps of creating the green enhancement mask and the blue enhancement mask are carried out in a contact printing process.

6. The process of claim 1, wherein the red separation, the green separation, and the blue separation are created from the original negative using red, green, and blue light, respectively, in a contact printing process.

7. The process of claim 2, wherein the step of combining the green separation with the green enhancement mask to create the improved green separation, and taking the blue separation and combining it with the blue enhancement mask to create the improved blue separation are carried out by exposing the green separation with a second pass of the green enhancement mask, and the improved blue separation is made by taking the blue separation and exposing it to a second pass with the blue enhancement mask.

8. The process of claim 1, wherein scene density correction in the faded color negative is accomplished by compensating the exposure of the green and blue enhancement masks.

9. The process for restoring color to a faded color negative, the process comprising the steps of:

generating a blue/green enhancement mask from the faded color negative by providing black and white autopositive orthochromatic film stock that is sensitive only to blue and green light, and by passing blue/green light through the faded color negative onto the autopositive orthochromatic film stock and developing unexposed areas to create the blue/green enhancement mask;

generating a red separation, a green separation, and a blue separation from the faded color negative by exposing black and white negative film stock and developing the exposed areas of the film negative; and combining the blue separation with the green/blue enhancement mask to form an improved blue separation.

10. A process of claim 9, further comprising the steps of combining the green separation with the blue/green enhancement masks to form an improved green separation and combining the blue separation with the green/blue enhancement mask to form an improved blue separation.

11. The process of claim 9, wherein the red separation, the green separation, and the improved blue separation can be recombined to form an enhanced color negative.

12. The process of claim 10, wherein the red separation, the improved green separation and the improved blue separation can be recombined to form an enhanced color negative.

13. The process of claim 9, wherein the steps of creating the blue/green enhancement mask is carried out in a contact printing process.

14. The process of claim 9, wherein the red separation, the green separation, and the blue separation are created from the faded color negative using red, green, and blue light, respectively, in a contact printing process.

15. The process of claim 10, wherein the step of combining the green separation with the blue/green enhancement mask to create an improved green separation, and taking the blue separation and combining it with the blue/green enhancement mask to create the improved blue separation are carried out by exposing the green separation with a second pass of the blue/green enhancement mask with green light, and the improved blue separation is made by taking the blue separation and exposing it to a second pass with the green/blue enhancement mask with blue light.

16. A process for restoring color of a faded color negative, the process comprising the steps of:

taking a faded color negative, and creating a blue enhancement mask of the faded negative by providing black and white autopositive orthochromatic film stock that is sensitive only to blue and green light, and by passing blue light through the faded color negative onto the autopositive orthochromatic film stock and developing unexposed areas to creates the blue enhancement mask;

taking the faded color negative and passing yellow biased light through the faded color negative onto intermediate film stock to generate unprocessed intermediate stock;

packing the blue enhancement mask with the unprocessed intermediate stock and passing blue light through the blue enhancement mask to create an improved intermediate stock.

17. A process of claim 16, wherein the blue enhancement mask is further packed with the original negative, and blue light is passed through the blue enhancement mask, the original negative and onto the unprocessed intermediate stock to create the improved intermediate stock.

18. The process of claim 16, wherein the steps of creating the blue enhancement mask, the unprocessed intermediate stock, and the improved intermediate stock are carried out in a contact printing process.

19. The process of claim 13, wherein the intermediate film stock is selected from one of negative film and interpositive film stock.

* * * * *